US005395720A

United States Patent [19]

Jongewaard et al.

[11] Patent Number: 5,395,720

[45] Date of Patent: Mar. 7, 1995

[54] DYE RECEPTOR SHEET FOR THERMAL DYE AND MASS TRANSFER IMAGING

[75] Inventors: Susan K. Jongewaard, North St. Paul; Robert A. Braun, St. Paul, both of Minn.

[73] Assignee: Minnesota Mining and Manufacturing Company, St. Paul, Minn.

[21] Appl. No.: 217,385

[22] Filed: Mar. 24, 1994

[51] Int. Cl.[6] ..... G03C 5/54

[52] U.S. Cl. ..... 430/17; 430/200; 430/201; 430/213; 430/262; 430/941; 503/227

[58] Field of Search ..... 430/200, 201, 203, 213, 430/941; 503/227

[56] References Cited

U.S. PATENT DOCUMENTS

| | | | |
|---|---|---|---|
| 4,853,365 | 8/1989 | Jongewaard et al. | 503/227 |
| 4,897,377 | 1/1990 | Marbrow | 503/227 |
| 4,914,078 | 4/1990 | Hann et al. | 503/227 |
| 4,943,555 | 7/1990 | Nakamoto et al. | 503/227 |
| 4,968,658 | 11/1990 | Beck et al. | 503/227 |
| 4,992,413 | 2/1991 | Egashira et al. | 503/227 |
| 5,225,392 | 7/1993 | Chang et al. | 503/227 |
| 5,232,892 | 8/1993 | Chang et al. | 503/227 |

*Primary Examiner*—Richard L. Schilling

*Attorney, Agent, or Firm*—Gary L. Griswold; Walter N. Kirn; Mark A. Litman

[57] ABSTRACT

A dye transfer receptor sheet suitable, for thermal dye transfer imaging is described. The receptor sheet comprises a substrate having a receptor layer comprising a vinyl resin mixed or blended with a linear saturated thermoplastic polyester having aliphatic and aromatic groups.

17 Claims, No Drawings

DYE RECEPTOR SHEET FOR THERMAL DYE AND MASS TRANSFER IMAGING

FIELD OF THE INVENTION

This invention relates to thermal transfer printing, and in particular to a novel thermal transfer receptor sheet for such printing using a receptor layer coated surface as a receptor element.

BACKGROUND OF THE INVENTION

In thermal dye transfer printing, an image is formed on a receptor sheet by selectively transferring a dye to a receptor sheet from a dye donor sheet placed in momentary contact with the receptor sheet. Material to be transferred from the dye donor sheet is directed by a thermal printhead, which consists of small electrically heated elements (print heads). These elements transfer image-forming material from the dye donor sheet to areas of the dye receptor sheet in an image-wise manner. Thermal dye transfer systems have advantages over other thermal transfer systems, such as chemical reaction systems, and thermal mass transfer systems. In general thermal dye transfer systems offer greater control of gray scale than these other systems, but they have problems as well. One problem is release of the dye donor and receptor layers during printing. This has been addressed often by the addition of dye-permeable release coatings applied to the surface of the dye receptor layer. Additionally, materials are required for use in the receptor layer having suitable dye permeability, mordanting properties, adhesion to the substrate, and long term light and thermal stability.

Recent advances in thermal dye transfer imaging systems describe thermal dye transfer receptor layers which can be coated out of solution and used on various surfaces to provide a high quality dye receiving layer. Such materials are described in U.S. Pat. Nos. 4,914,078 and 4,968, 658. These layers are coated out of solution from presently acceptable solvents such as methyl ethyl ketone.

Polyvinyl chloride derivatives and copolymers have been heavily used in thermal dye transfer receptor sheets as receptor layers, because of their properties in these areas. For example, U.S. Pat. No. 4,853,365 discloses that chlorinated polyvinyl chloride, used as a dye receptor, has good dye solubility and high dye receptivity. Similarly, vinyl chloride/vinyl acetate copolymers have also been used as receptor layers in thermal dye transfer receptor sheets as described in Japanese published application nos. 29,391 (1990) and 39,995 (1990). Japanese published application no. 160,681 (1989) discloses dye acceptance layers comprising polyvinyl chloride-polyvinyl alcohol copolymers, and Japanese published application nos. 43,092 (1990), 95,891 (1990) and 108,591 (1990) discloses dye image receiving layers comprising a hydroxy modified polyvinyl chloride resin and an isocyanate compound. U.S. Pat. No. 4,897,377 discloses a thermal transfer printing receiver sheet comprising a supporting substrate coated on at least one surface with an amorphous polyester resin. Published European patent application 133,012 (1985) discloses a heat transferable sheet having a substrate and an image-receiving layer thereon comprising a resin having an ester, urethane, amide, urea, or highly polar linkage, and a dye-releasing agent, such as a silicone oil, being present either in the image-receiving layer or as a release layer on at least part of the image receiving layer.

Published European patent application 133,011 (1985) discloses a heat transferable sheet based on imaging layer materials comprising first and second regions respectively comprising (a) a synthetic resin having a glass transition temperature of from −100° to 20° C., and having a polar group, and (b) a synthetic resin having a glass transition temperature of 40° C. or above.

U.S. Pat. No. 4,968,658 teaches the use of a thermal transfer receptor surface with a receiver coating comprising a dye-receptive material, a dye-permeable release agent, and an alkoxylated Bisphenol A unsaturated polyester. Fumaric acid may also be used in the layer.

SUMMARY OF THE INVENTION

It is an aspect of the invention to provide a thermal dye or mass transfer receptor element in intimate contact with a dye or thermal mass transfer donor sheet, the receptor comprising a supporting substrate having on at least one surface thereof a dye or thermal mass transfer receptive receiving layer comprising a vinyl chloride resin and a linear saturated thermoplastic polyester comprising both aliphatic and aromatic groups. There may also be present in the receptor layer a minor amount of melamine crosslinking agent and/or other isocyanate crosslinking agents. The receptor sheet comprises the substrate (with or without primer) and the dye or thermal mass transfer receptor layer coated on the substrate. The dye or thermal mass transfer receptive receiving layer is positioned in intimate contact with a dye or thermal mass transfer donor layer during the thermal transfer process.

It is another aspect of this invention to provide thermal transfer receptor sheets as described above wherein a polysiloxane release layer is coated on the dye or thermal mass transfer receptive receiving layer or a release agent is incorporated into the dye receptor layer.

The thermal transfer receptor sheets of the invention have good dye and mass transfer receptivity and excellent dye-image thermal stability properties, and can provide an accurate proofing image which resembles a printed image.

DETAILED DESCRIPTION OF THE INVENTION

The thermal dye and mass transfer receptor sheets of the invention comprise a supporting organic polymeric substrate (e.g., paper or polymeric film), a thermal mass transfer or dye receptive layer comprising a vinyl resin and a mixed linear, saturated thermoplastic polyester adhesive having both aliphatic and aromatic based groups. The receptive layer is optionally coated with a polysiloxane release layer or may contain release agents therein. The linear, saturated polyester thermoplastic adhesive is incorporated within the receiving layer.

The dye or mass transfer image receptor layer of the present invention must be compatible as a coating with a number of resins for mass transfer and a number of dyes for thermal dye transfer. Since different dye transfer media manufacturers generally use different dye formulations in their donor sheets, the dye receiving layer should have an affinity for several different dyes. Because the transfer of dye from the dye donor sheet to the dye receptor sheet is essentially a contact process, it is important that there be intimate contact (e.g., no air gaps or folds) between the dye donor sheet and the dye receptor sheet at the instant of heating to effect imaging.

Many different dye receptor layer compositions are known in the art and they are generally selected from polymer classes and mixtures thereof such as poly(vinyl chloride), chlorinated poly(vinyl chloride), vinyl acetate/vinyl chloride copolymers, silicone surfaces on polymeric bases, poly(methyl acrylate), polyvinyl acetals (e.g., polyvinyl butyral) and the like, which are preferred classes of polymers for receptor layers. Surface modifying agents and treatments to alter opacity, smoothness, adhesion of subsequent coatings, tint, and dye absorption are also conventionally used. When used as a dye receptive layer, poly(vinyl chloride) is often used with an additional resin, and usually additional or special plasticizers. Examples of such combinations may be found generally in the art and, for example, in EPO 227 091, EPO 228 066, EPO 133011, EPO 133012, and EPO 228 065. Since poly(vinyl chloride) is a rigid resin, the purpose of many of these additives is to plasticize the polymer.

Chlorinated poly(vinyl chloride) (CPVC) is a homopolymer of poly(vinyl chloride) that has been subjected to a chlorination reaction. CPVC has many of the good dye receptive properties of poly(vinyl chloride) and retains them at higher temperatures than PVC.

U.S. Pat. Nos. 4,990,485; 4,931,423; 4,927,666; 4,914,078; and 4,910,189 show receptor media which have compositions and constructions which could be used in combination with the layers of the present invention.

The proper selection of softening temperature (e.g. glass transition temperature, Tg) of the dye receiving layer is important in the preparation of the thermal dye transfer receptor sheet. Preferably the dye receiving layer for thermal dye transfer imaging should at least allow or enable increased solubilization of the dye, dye migration, dye permeation, and/or surface release of the dye between the donor and receptor surfaces below the temperatures employed to transfer dye from the dye donor sheet. The softening point, however, must not allow the resin to become distorted, stretched, wrinkled, etc. For use with thermal mass transfer imaging, the mass transfer receptor layer should be readily bonded to by mass transfer resins, and the resins with the pigments therein. In addition, the dye receptor sheet is preferably non-tacky and capable of being fed reliably into a thermal printer, and is of sufficient durability that it will remain useful after handling, feeding, and removal from imaging.

The dye or mass transfer receptor sheet may be prepared by introducing the various components for making the receiving layer with suitable solvents (e.g., tetrahydrofuran (THF), methyl ethyl ketone (MEK), toluene, and mixtures thereof. The resulting solutions are mixed at room temperature (for example), then the resulting mixture is coated onto the substrate and the resultant coating dried, preferably at elevated temperatures. Suitable coating techniques include knife coating, roll coating, curtain coating, spin coating, extrusion die coating, gravure coating, etc. The receiving layer is preferably free of any observable colorant (e.g., an optical density of less than 0.2, preferably less than 0.1 absorbance units). The thickness of the receiving layer is from about 0.001 mm to about 0.1 mm, and preferably 0.005 mm to 0.010 mm.

Materials that have been found to be particularly useful for forming the receiving layer include sulfonated hydroxy epoxy functional vinyl chloride copolymers as described in U.S. Pat. No. 4,910,189 arad in another embodiment blends of sulfonated hydroxy epoxy functional vinyl chloride copolymers with other polymers. Any of the well known and/or commercially available materials known in the art as dye or thermal mass transfer receptor polymeric compositions may be used in the practice of the present invention. Polyvinyl resins, and especially polyvinyl chloride polymers and copolymers are widely used in the art. Chlorinated polyvinyl chlorides and their blends have also found wide acceptance. Other vinyl polymers and copolymers are also used in the art. Blends of resins are often used to achieve an appropriate balance of properties in the receiving layers of the art. The limiting factors to the resins chosen for the blend vary only to the extent of compounding necessary to achieve the property desired. Preferred blendable additives include, but are not limited to polyvinyl chloride, acrylonitrile, styrene-acrylonitrile copolymers, polyesters (especially bisphenol A fumaric acid polyester), acrylate and methacrylate polymers (especially polymethyl methacrylate), epoxy resins, and polyvinyl pyrrolidone. When an additional polymer, copolymer, or resin is used (as with an epoxidized, sulfonated polyvinyl chloride resin as in U.S. Pat. No. 4,910,189) the additional polymer is usually added in an amount of 75 percent by weight or less of the resinous composition of the dye or thermal mass transfer receiving layer, preferably in the amount of 25 to 75 percent by weight for non-release polymers, or 0.01 to 15% for release polymers.

Release polymers are characterized by low surface energy and include silicone and fluorinated polymers. Non-limiting examples of release polymers are poly dimethyl siloxanes, perfluorinated polyethers, etc. Other conventional additives include, but are not limited to, surfactants, plasticizers, UV stabilizers, coating aids, and the like.

Suitable substrate materials may be any flexible material.. Suitable substrates may be smooth (preferably) or rough, transparent, opaque, and continuous or sheetlike. They may be porous or essentially non-porous. Preferred backings are paper, white-filled or transparent polyethylene terephthalate or other temperature stable thermoplastic organic film forming polymers (e.g., polycarbonates, polyolefins, etc.) Non-limiting examples of materials that are suitable for use as a substrate include polyesters, especially polyethylene terephthalate, polyethylene naphthalate, polysulfones, polystyrenes, polycarbonates, polyimides, polyamides, cellulose esters, such as cellulose acetate and cellulose butyrate, polyvinyl chlorides and derivatives, polyethylenes, polypropylenes, etc. The substrate generally has a thickness of 0.02 to 1.5 mm, preferably 0,025 mm to 0.40 min. If the substrate is supported by a liner or other supporting backing, then the preferred range for the substrate alone would be 0.0006 to 0.8 mm. The receptor substrate may be porous or non-porous, and individual layers of the receptor or donor sheet may be porous or non-porous so as to adjust thermal properties in the sheets and the transfer process.

By "non-porous" in the description of the invention it is meant that ink, paints or other liquid coloring media will not readily flow through the substrate (e.g., less than 0.05 ml per second at 7 torr applied vacuum, preferably less than 0.02 ml per second at 7 torr applied vacuum). The lack of significant porosity prevents absorption of the heated receptor layer into the substrate. However, porosity has also been found to be beneficial in localizing thermal events to the region of dye transfer and thereby increasing transfer efficiency and quality.

The substrates of the present invention may also have a supporting backing to help in transporting the media through the printer and the imaging device. This is essentially a non-critical, additional and optional structural feature. Such backings may be directly or adhesively adhered to the substrate.

The thermal dye or mass transfer receptor layers of the invention are used in combination with a dye donor sheet wherein a dye image is transferred from the dye donor sheet to the receptor sheet by the application of heat. The heat may be applied by printheads, lasers, laser diodes, focused radiation, and the like, as is understood in the art. The finer the resolution of the applied heat, the finer the resolution of the image, within reasonable limits. The dye donor layer is placed in contact with the receiving layer of the receptor sheet and selectively heated according to a pattern of information signals whereby the dyes (or in the case of thermal mass transfer, the dyes or pigment in a binder) are transferred from the donor sheet to the receptor sheet. A pattern is formed thereon in a shape and density according to the intensity of heat applied to the donor sheet. The heating source may be an electrical resistive element, a laser (preferably an infrared laser diode), an infrared flash, a heated pen, or the like. The quality of the resulting image can be improved by readily adjusting the size of the heat source that is used to supply the heat energy, the contact position of the donor sheet and the receptor sheet, and the heat energy. The applied heat energy is controlled to give light and dark gradation of the image and for the efficient diffusion of the dye from the donor sheet to ensure continuous gradation of the image as in a photograph. Mass transfer imaging would give more limited gradation, but providing solid blocks (as in half tone imaging systems) for graphics, lettering borders, and the like. Thus, by using in combination with a dye donor sheet, the dye receptor sheet of the invention can be utilized in the print preparation of a photograph by printing, facsimile, or magnetic recording systems wherein various printers of thermal printing systems are used, or print preparation for a television picture, or cathode ray tube picture by operation of a computer, or a graphic pattern or fixed image for suitable means such as a Video camera, and in the production of progressive patterns from an original by an electronic scanner that is used in photomechanical processes of printing.

Suitable thermal dye transfer donor sheets for use in the invention are well known in the thermal imaging art. Some examples are described in U.S. Pat. No. 4,853,365 which is hereby incorporated by reference.

Other additives and modifying agents that may be added to the dye or mass transfer receiving layer include UV stabilizers, heat stabilizers, suitable plasticizers, surfactants, release agents, antistatic agents, etc., used in the receptor sheet of the present invention. Similarly, mass transfer receptor layers will contain additives that will facilitate the bonding and transfer of the mass transfer donor materials onto the receptor sheet.

In a preferred embodiment, the dye or mass transfer receiving layer of the invention is overcoated with a release layer or may contain release ingredients therein. The release layer must be permeable to the dyes used under normal transfer conditions in order for dye to be transferred to the receiving layer. Release materials suitable for this layer may be fluorinated polymers such as polytetrafluoroethylene, and vinylidene fluoride/vinylidene chloride copolymers, and the like, as well as dialkylsiloxane based polymers such as polydimethylsiloxane, modified organopolysiloxanes, polyvinyl butyral/siloxane copolymers such as Dai-Allomer TM SP-711 (manufactured by Daicolor Pope, Inc., Rock Hill, SC) and urea-polysiloxane polymers.

Alternatively, improved release properties may be achieved by addition of a silicone or mineral oil to the receiving layer during formulation.

An optional primer layer composition of the present invention can comprise any material that enhances adhesion or gives coloration to the overall composition. The primer layer should be compatible with the other layers in the receptor element, as by not reacting with ingredients in other layers which would deleteriously affect performance.

The preferred linear, saturated thermoplastic polyester adhesive present in the dye receiving layer, of the present invention, is a polyethylene terephthalate adhesive having a molecular weight in the range of 10,000 to 40,000, preferably 15,000 to 30,000. Such polyesters are available from Bostik Chemical group, Emhart Corporation (e.g., Bostik 7695, 7651, 7614, and 7660) or from Goodyear Corp. (Vitel 3200, 3300, and 3350). These commercial Bostik adhesives are available in toluene/MEK solvent solutions or MEK solutions, with viscosities ranging from 1200–1500 cps for 7695 to 110–160 cps for 7614. The Vitel resins are solids.

EXAMPLES

The term "PVC" refers to polyvinyl chloride.

The term "PET" refers to polyethylene terephthalate.

The term "Meyer bar" refers to a wire wound rod such as that sold by R & D Specialties, Webster, N.Y.

The following dyes are examples of useful thermal dye transfer materials in the practice of one aspect of the present invention:

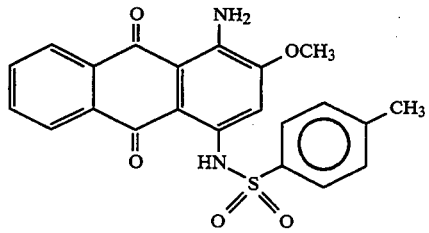

AQ-1

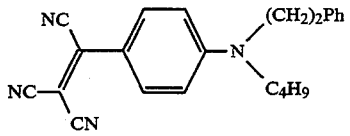

Mitsubishi Dye HSR-31
U.S. Pat. No. 4,816,435

-continued

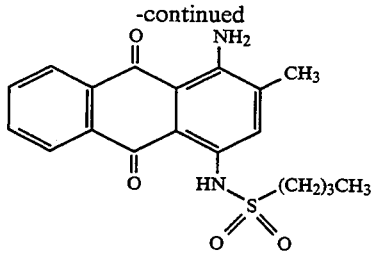

Butyl Magenta

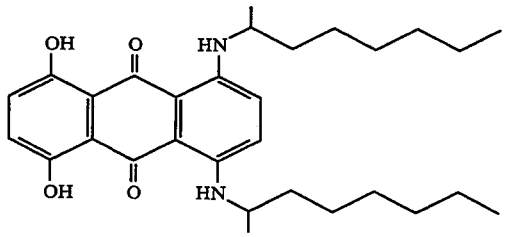

Octyl Cyan

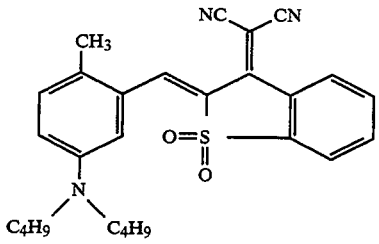

Foron Brilliant Blue

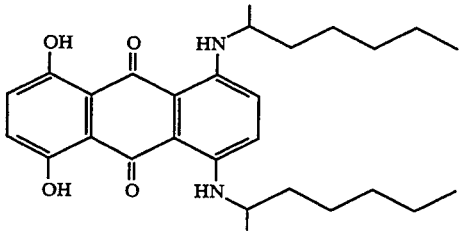

Heptyl Cyan

Butyl Magenta may be prepared as described in U.S. Pat. No. 4,977,134 (Smith et al.); HSR-31 was purchased from Mitsubishi Kasel Corp., Tokyo, Japan; AQ-1 was purchased from Alfred Bader Chemical (Aldrich Chemical Co., Milwaukee, WI); Foron Brilliant Blue was obtained from Sandoz Chemicals, Charlotte, NC; Heptyl Cyan and Octyl Cyan were prepared according to the procedures described in Japanese published application 60-172,591.

A preferred example of a thermal receptor material is a 10% solvent mixture of VYNS-3 (a vinyl chloride/vinyl acetate copolymer available from Union Carbide) and a multi-functionalized polyvinyl chloride (MR-120 available from Nippon Zeon). These two polymers are made into solutions with methyl ethyl ketone at a 12/1 ratio of VYNS-3 to MR-120. After thoroughly mixing this solution, 30% by weight (total solids) of Bostik 7695 to the 12/1 VYNS-3/MR210 total solids and 1.5% by weight solids of Cyastat LS (a quaternary ammonium 3-lauramidopropyl triamethylammonium methylsulfate compound)were added. Prior to coating, KF 393 (a modified organopolysiloxane made by Shin-Etsu Chemical Co.) was added at a 0.07 to 1 ratio (with respect to the MR-120). which can be applied from solution, This solution was Meyer bar coated onto 5 mil (0.127 mm) PET film and oven dried at 220 degrees Fahrenheit.

This donor sheet was used to transfer the dye to the receptor using a thermal printer. One useful printer used in the practice of the present invention was a Kyocera raised glaze thin film thermal print head (Kyocera Corp., Kyoto, Japan) with 8 dots per mm and 0.3 watts per dot. In normal imaging, the electrical energy varies from 0 to 16 joules/cm$^2$, which corresponds to head voltages from 0 to 14 volts with a 23 msec burn time. In all examples, the 3M Rainbow TM DeskTop Color Proofing system with 3M supplied donor ribbon was used.

The key features that the polyester additive must contribute to the dye receptive composition, comprising at least 50 percent of an additional binder, including but not exclusively, polyvinyl chloride, Chlorinated polyvinyl chloride, or polyvinyl chloride/polyvinyl acetate copolymers, include:

1. Acceptable mass transfer.
2. Acceptable dye transfer.
3. Acceptable dye transfer image density (four color black >2.0 ROD density units).
4. Adhesion to numerous surfaces.
5. Acceptable dye image stability to heat and light exposure.
6. Aceptable shelf life stability of the receptor surface prior to and after imaging.
7. Non blocking/no tack.
8. Film former/smooth, uniform coating in order to provide intimate contact with donor ribbon.

Components used

VYNS -3 -Vinyl chloride-vinyl acetate copolymer from Union Carbide

MR 120 -Vinyl chloride copolymer from Nippon Zion Co. Ltd.

KF 393 -Modified organopolysiloxane from Shin-Etsu

Bostik 7695 -Polyester adhesive, toluene/MEK solvent. 17° F. flash point, viscosity of 1200–1500 cps. Intrinsic viscosity of 0.9–1.0 centistrokes. Glass transition temperature −18° C.

Cyastat LS -Quaternary ammonium 3-Lauramidopropyl triamethyl ammonium methylsulfate compound from American Cyanamid.

The key features required of polyester additives within this invention were identified by studying a series of thermoplastic copolyesters having both aromatic and aliphatic based groups. We also looked at polyester resins with only aromatic based groups, polyester resins with only aliphatic groups and, just aliphatic based polymers.

The polymers containing only aliphatic groups were polyester plasticizers such as Paraplex H-25 from Rohm and Haas (a sebacic acid polyester), Paraplex H-50 (an adipic acid polyester) and Plastolein 9750 from Emery Industries (an azalaic acid polyester). All aliphatic polyesters in this study failed to perform adequately in the dye receptor surface because of their inability to provide an adequate mass transfer surface due, to the plasticizers's lower glass transition temperature, which produced an oily/liquid film surface. The aliphatic polyester plasticizers were generally mobile in the coated film and hindered dye stability and dye transfer uniformity.

The polyester polymers derived from aromatic groups such as those found in thermoplastic polyester films (e.g., Vitel 2200)fail to perform adequately as the dye receptor surface because of their low acceptance of dye image density and usually poorer dye stability to heat and light. Other aromatic derived resins similar to the Vitel 2200, such as polybutylene terephthalate (PBT) and polyethylene terephthalate (PET) consist of the following components respectively. (PBT)=terephthalic acid and 1,4 butanediol (PET)-=terephthalic acid and ethylene glycol showed similar problems.

The following materials are examples of copolyesters with aromatic and aliphatic functional groups used in this evaluation. Vitel 2200, which contains only aromatic groups is included as a reference material i see the table below).

| Raw Materials | Type | Bostik 7695 | Bostik 7660 | Bostik 7651 | Bostik 7614 | Vitel 2200 | Vitel 3200 | Vitel 3300 | Vitel 3550 | Vitel 3800 |
|---|---|---|---|---|---|---|---|---|---|---|
| Terephthalic Acid | A 1,4 | 24% | 14% | | | 25% | 33% | 24% | 15% | |
| Isophthalic Acid | A 1,3 | 20% | | | | 24% | | 9% | 10% | |
| Adipic Acid | C4 | 17% | 7% | | | | | | | |
| Sebacic Acid | C8 | 7% | 7% | | | | 15% | | | |
| Azelaic Acid | C7 | | | | | | | 15% | 24% | |
| 1,6 Hexanediol | S | 15% | 7% | | | | | | | |
| 1,4 Butanediol | S | | 42% | | | | | | | |
| Ethylene Glycol | S | 36% | | | | 26% | 32% | 31% | 51% | |
| Neopentyl Glycol | B | | | | | 24% | 20% | 20% | | |
| Tg °C. | | −18 | −15 | 20 | 56 | 63 | 12 | 11 | −15 | −33 |

A — Aromatic S — Straight B — Branched

Vitel 3800 has a higher aliphatic to aromatic ratio than the other Vitel resins shown in the table. Bostik 7651 and Bostik 7614 have a higher aromatic to aliphatic ratio than do the other Bostik resins.

Examples (using the polymers listed in the Table above)

All solutions below were coated with a #32 Meyer bar, hot air gun dried and then placed into a 230° F. dry oven for 4 minutes. Coatings were done on 4 mil clear polyester film. All samples were imaged using the 3M Rainbow TM model 2710 Desktop color proofing system. All density readings were taken with a Gretag SPM 100 densitometer.

Standard solution

| Resin | Amount in grams |
|---|---|
| VYNS-3 (10% solids in MEK) | 24.0 |
| MR120 (10% solids in MEK) | 2.0 |
| Cyastat LS (10% solids in MEK) | 0.43 |
| KF 393 (1.0% solids in MEK) | 1.4 |

To the standard solution above the following copolyester/polyester resins were added:

| | | |
|---|---|---|
| 1. | Bostik 7695 (12% solids in MEK) | 14.2 grams |
| 2. | Vitel 3550 (10% solids in MEK) | 17.0 grams |
| 3. | Vitel 3200 (10% solids in MEK) | 17.0 grams |
| 4. | Vitel 3300 (10% solids in MEK) | 17.0 grams |
| 5. | Vitel 3800 (10% solids in MEK) | 17.0 grams |
| 6. | Vitel 2200 (10% solids in MEK) | 17.0 grams |
| 7. | No other additives - standard solution only | |

-continued

| | |
|---|---|
| 8. | Vitel 3500 alone - no standard solution |
| 9. | Vitel 3800 alone - no standard solution |
| 10. | Bostik 7695 alone - no standard solution |

RESULTS:

| Sample | Density (ROD) Yellow | Magenta | Cyan | Black (4 color) |
|---|---|---|---|---|
| 1 | 1.5 | 1.06 | 1.1 | 1.9 |
| 2 | 1.2 | 0.95 | 1.03 | 1.75 |
| 3 | 1.1 | 0.9 | 0.98 | 1.67 |
| 4 | 1.1 | 0.93 | 1.0 | 1.65 |
| 5 | 1.6 | 1.1 | 1.2 | 1.9 |
| 6 | 0.9 | 0.88 | 0.8 | 1.4 |
| 7 | 1.27 | 0.95 | 0.93 | 1.60 |
| 8 | Surface was too tacky to run through the printer and image | | | |
| 9 | Surface was too tacky to run through the printer and image | | | |
| 10 | Surface was too tacky to run through the printer and image | | | |

Conclusion

The previously mentioned copolyester resins, aromatic/aliphatic based, impart the following qualities:

1. Compatible mixing with known dye receptive and mass transfer formulations
2. Adequate adhesion, to numerous surfaces (i.e. polyolefins, paper substrates, and polyethylene terephthalate films), without imparting a tacky receptor surface layer.
3. Non-detrimental to receptor layer stability, before or after imaging, due to environmental conditions.

The above qualities are achieved while surprisingly increasing the overall imaged density form the dye transfer. The unique properties of the resin type provides the stiffness and elasticity combination necessary for the dye receptive layer to enhance the transfer of dye from the donor sheet while maintaining good mass transfer characteristics. This enhanced transfer of dye is not deleterious to the stability of the final image.

As seen in the previous examples, polyester resins like Vitel 2200 are too hard (high tensile strength and low elongation) which result in lower image densities. While aliphatic polyesters, like Plastolein 9750, is a softer resin (low tensile strength and elongation) which increases dye solubilization giving generally higher image densities. These excellent wetting properties generally cause the transferred dye to be unstable and more susceptible to detrimental effects from environmental conditions.

Additional studies were performed on the Bostik copolyester resins from Emhart Corporation. Samples 1–11 measured image density differences resulting from percent concentration increases in the level of copolyester resin (Bostik 7695). Samples 12–14 measured density effects due to several Bostik copolyester resins.

| Formulations: | | |
|---|---|---|
| Number | Components | Amount |
| 1 | VYNS-3 | 2.4 grams |
| | MR 120 | 0.2 grams |
| | KF393 | 0.014 grams |
| | MEK | 23.5 grams |

to the above formulation (number) varying amounts of Bostik 7695 were added.

| Number | Amount of Bostik 7695 to total percent solids: |
|---|---|
| 2 | 5 |
| 3 | 10 |
| 4 | 15 |
| 5 | 20 |
| 6 | 25 |
| 7 | 30 |
| 8 | 37 |
| 9 | 40 |
| 10 | 46 |
| 11 | 50 |

| Number | Components | Amount |
|---|---|---|
| 12 | VYNS-3 | 2.4 grams |
| | MR120 | 0.2 grams |
| | KF393 | 0.014 grams |
| | Bostik 7651 | 1.56 grams (*37% of total solids) |
| | MEK | 29.2 |
| | Toluene | 5.72 |
| 13 | VYNS-3 | 2.4 grams |
| | MR120 | 0.2 grams |
| | KF393 | 0.014 grams |
| | Bostik 7614 | 1.56 grams (*37% of total sohds) |
| | MEK | 29.2 |
| | Toluene | 5.72 |
| 14 | VYNS-3 | 2.4 grams |
| | MR120 | 0.2 grams |
| | KF393 | 0.014 grams |
| | Bostik 7660 | 1.56 grams (*37% of total solids) |
| | MEK | 29.2 |
| | Toluene | 5.72 |

*All solutions were coated with a # 32 Meyer bar. Samples 1–11 were coated onto FPG 200 Kimdura paper base. Sample 8 was also coated onto an aluminum vapor coated film along with samples 12–14. All samples were not gun dried followed by 4 minutes at 220° F.

| Results: | | | | |
|---|---|---|---|---|
| Formula | ROD black | ROD yellow | ROD magenta | ROD cyan |
| 1 | 1.33 | 1.52 | 1.34 | 1.40 |
| 2 | 1.37 | 1.51 | 1.39 | 1.43 |
| 3 | 1.39 | 1.58 | 1.40 | 1.50 |
| 4 | 1.43 | 1.72 | 1.44 | 1.53 |
| 5 | 1.46 | 1.74 | 1.48 | 1.63 |
| 6 | 1.47 | 1.84 | 1.51 | 1.69 |
| 7 | 1.50 | 1.85 | 1.55 | 1.80 |
| 8 | 1.49 | 2.00 | 1.60 | 1.77 |

-continued

| Results: | | | | |
|---|---|---|---|---|
| Formula | ROD black | ROD yellow | ROD magenta | ROD cyan |
| 9 | 1.52 | 1.98 | 1.60 | 1.83 |
| 10 | 1.50 | 2.01 | 1.65 | 1.83 |
| 11 | Mass transferred - unable to take readings | | | |
| 12 | 1.32 | 1.76 | 1.45 | 1.41 |
| 13 | 1.34 | 1.92 | 1.56 | 1.49 |
| 14 | 1.43 | 1.99 | 1.69 | 1.61 |

*all readings were taken using a Gretag SPM 100 densitometer.

Conclusion

Bostik 7695 and Bostik 7660 gave higher imaging densities over the other Bostik resins. Both of these products have the lower glass transition temperatures.

With the increased addition of Bostik 7695, up to 46 percent loading, the dye transferred density increased without unwanted mass transfer of the dye/binder Loadings of Bostik above 46 percent total solids tend to produce unwanted levels of mass transfer.

We claim:

1. A thermal transfer system comprising a thermal transfer donor element in contact with a thermal transfer receptor element, said thermal dye transfer receptor element comprising a substrate having a receptor layer comprising a vinyl resin and a linear saturated thermoplastic polyester having both aliphatic and aromatic groups derived from diacid monomers, said receiving layer being in contact with said thermal transfer donor element.

2. The system of claim 1 wherein said vinyl resin comprises a vinyl chloride copolymer having a glass transition temperature between 50 and 85° C., a weight average molecular weight between 10,000 and 100,000 g/mol, a hydroxyl equivalent weight between 1000 and 7000 g/mol, a sulfonate equivalent weight between 5,000 and 40,000 g/mol, and an epoxy equivalent weight between 500 and 7000 g/mol.

3. The thermal transfer system of claim 1 wherein said receptor layer is a thermal dye transfer receiving layer with a polysiloxane release layer coated on or in said receiving layer.

4. The thermal transfer system of claim 1 wherein the receptor layer further comprises an ultraviolet radiation absorber.

5. The thermal transfer system of claim 1 wherein said vinyl resin comprises a vinyl chloride polymer or copolymer, or a chlorinated poly(vinyl chloride) polymer or copolymer.

6. The thermal transfer system of claim 4 wherein said vinyl resin comprises a vinyl chloride polymer or copolymer, or a chlorinated polyvinyl chloride polymer or copolymer.

7. The thermal transfer system of claim 1 wherein said thermal donor sheet comprises a substrate having on only one surface thereof a layer comprising a thermally transferrable dye.

8. A process of transferring an image using the thermal transfer system of claim 1 wherein heat is applied in an imagewise distribution to a side of said thermal donor sheet farthest from said receptor layer, said heat being applied in an amount sufficient to thermally transfer material from said donor element.

9. A thermal dye transfer receptor dement comprising a substrate having on at least one surface thereof a receptor layer comprising a vinyl resin mixed with a linear saturated thermoplastic polyester adhesive having both aliphatic and aromatic groups derived from diacid monomers.

10. The dement of claim 9 wherein said vinyl resin comprises a vinyl chloride copolymer having a glass transition temperature between 55 and 70° C., a weight average molecular weight between 20,000 and 60,000 g/mol, a hydroxyl equivalent weight between 1500 and 4000 g/mol, a sulfonate equivalent weight between 9,000 and 23,000 g/mol, and an epoxy equivalent weight between 500 and 7000 g/mol.

11. An image bearing sheet comprising a substrate having on at least one surface thereof a receptor layer comprising a vinyl resin mixed with a linear saturated thermoplastic polyester having both aliphatic and aromatic groups derived from diacid monomers and said receptor layer having an image thereon.

12. The sheet of claim 11 wherein said vinyl resin comprises a vinyl chloride copolymer having a glass transition temperature between 59 and 65° C., a weight average molecular weight between 25,000 and 55,000 g/mol, a hydroxyl equivalent weight between 1890 and 3400 g/mol, a sulfonate equivalent weight between 11,000 and 19,200 g/mol, and an epoxy equivalent weight between 500 and 7000 g/mol, and on said dye receptive layer at least one dye distributed in an imagewise manner.

13. The thermal transfer element of claim 11 wherein a polysiloxane release layer is coated on or in said receptor layer.

14. The thermal transfer imaging system of claim 1 wherein said donor element is a thermal mass transfer donor element having a donor layer comprising a thermally transferable binder with pigment or dye therein.

15. A thermal transfer imaging system comprising a thermal mass transfer receptor sheet in intimate contact with a thermal mass transfer donor sheet, said receptor sheet comprising a substrate having on at least one surface thereof in contact with said thermal mass transfer donor sheet a receptor layer comprising a vinyl chloride polymer or copolymer mixed with a linear, saturated thermoplastic polyester having both aliphatic and aromatic groups derived from diacid monomers.

16. An image bearing sheet comprising a substrate having on at least one surface thereof a receptor layer comprising a vinyl resin mixed with a linear, saturated thermoplastic polyester having both aliphatic and aromatic groups derived from diacid monomers.

17. The sheet of claim 16 wherein said receptor layer also has a polysiloxane on or in said receiving layer.

* * * * *

UNITED STATES PATENT AND TRADEMARK OFFICE

CERTIFICATE OF CORRECTION

PATENT NO. : 5,395,720

DATED : March 7, 1995

INVENTOR(S) : Jongewaard et al.

It is certified that error appears in the above-indentified patent and that said Letters Patent is hereby corrected as shown below:

Column 3, line 68, delete "arad" and insert --and--.

Column 4, line 53, delete "0,025 mm" and insert --0.025 mm--.

Column 4, line 54, delete "min." and insert --mm.--.

Column 9, line 16, delete "material i see" and insert --material (see--.

Column 11, line 55, delete "not" and insert --hot--.

Column 12, line 66, delete "dement" and insert --element--.

Column 13, line 4, delete "dement" and insert --element--.

Signed and Sealed this

Twenty-second Day of August, 1995

Bruce Lehman

*Attest:*

BRUCE LEHMAN

*Attesting Officer*

*Commissioner of Patents and Trademarks*